United States Patent [19]

Longo et al.

[11] Patent Number: 5,065,070

[45] Date of Patent: Nov. 12, 1991

[54] SPUTTERED SCANDATE COATINGS FOR DISPENSER CATHODES

[75] Inventors: Robert T. Longo, Arcadia; Mario A. Barillas, Carson, both of Calif.; Ralph Forman, Rocky River, Ohio

[73] Assignee: Hughes Aircraft Company, Los Angeles, Calif.

[21] Appl. No.: 696,399

[22] Filed: May 6, 1991

Related U.S. Application Data

[62] Division of Ser. No. 632,194, Dec. 21, 1990, Pat. No. 5,041,757.

[51] Int. Cl.[5] ..... H01J 1/28

[52] U.S. Cl. ..... 313/346 DC

[58] Field of Search ..... 313/346 DC, 346 R

[56] References Cited

U.S. PATENT DOCUMENTS

| | | | |
|---|---|---|---|
| 3,121,048 | 2/1964 | Haas | 313/346 DC |
| 4,007,393 | 2/1977 | Van Statum et al. | 313/346 R |
| 4,427,916 | 1/1984 | Shroff | 313/346 R |
| 4,625,142 | 11/1986 | Van Esdonk et al. | 313/346 DC |
| 4,855,637 | 8/1989 | Watanabe et al. | 313/346 R |
| 5,006,753 | 4/1991 | Hasker et al. | 313/346 R |

*Primary Examiner*—Palmer C. DeMeo

*Attorney, Agent, or Firm*—Terje Gudmestad; W. K. Denson-Low

[57] ABSTRACT

A low work function surface for a dispenser cathode structure. The cathode structure comprising a heater and an electron emitting surface substrate or core composed of a porous tungsten matrix impregnated with a barium containing impregnant distributed therethrough. The structure is made by a method in which a nanometer thick layer of scandium oxide is sputtered onto the outermost surface of the impregnated tungsten core, or substrate, and then oxidized by exposing the sputtered scandium oxide surface layer to an oxygen atmosphere. The oxidized surface layer is activated by turning on the heater, for example, to cause the release of a small portion of the barium in the barium-containing impregnant. Some of the released barium migrates into the scandium oxide surface layer to form a monolayer of barium oxide on at least a portion thereof.

6 Claims, 2 Drawing Sheets

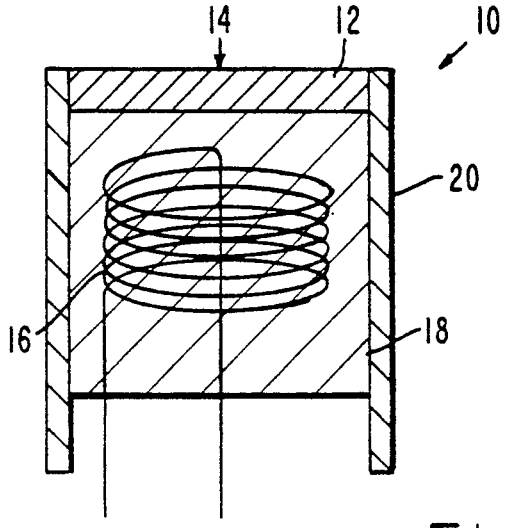
Fig. 1.
Fig. 2.
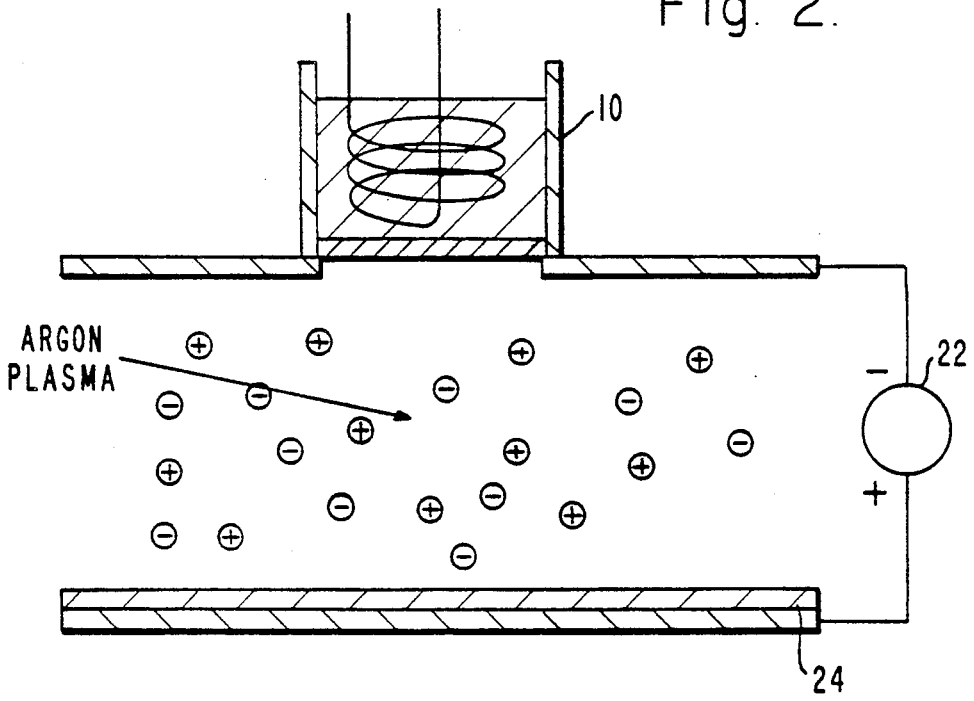

SPUTTERED SCANDATE COATINGS FOR DISPENSER CATHODES

This is a division of application Ser. No. 632,194, filed Dec. 21, 1990, now U.S. Pat. No. 5,041,757.

BACKGROUND

The present invention relates to low work surface function coatings for high current density dispenser cathodes and more particularly to barium-activated scandium oxide surface coatings for such cathodes, and methods for making same.

High current density dispenser cathodes are widely used as the electron source in display tubes, camera tubes, oscilloscope tubes, klystrons, transmitter tubes and the like. A characteristic of such cathodic structures is that there is a functional separation between the electron emissive surface and a store of emissive material which serves to produce a sufficiently low work function of the emissive surface.

One type of dispenser cathode is a "scandate" cathode, in which the electron emission takes place from the surface of a porous matrix of, for example, tungsten impregnated with a barium-calcium aluminate mixture which is distributed therethrough. In these cathodes, the surface work function is reduced by impregnating or embedding at least the top surface of the metal matrix with an electron emissive material comprised of scandium oxide ($Sc_2O_3$). When this is done, the finished product has a lower surface work function and better long term stability, as compared to either uncoated barium impregnated tungsten dispenser cathodes or to dispenser cathodes coated with a mixture of osmium and ruthenium (surface work function 1.80 to 1.85 eV).

Scandium oxide is, however, a semiconductor/insulator and, at high current densities, its resistance to electron current flow causes significant problems when the oxide particles are in or above the range of microns in size. While this problem has been recognized, procedures developed to overcome it have, so far, not proven to reliably produce high quality materials at a relatively reasonable cost. For example, Hasker et al. disclose in U.S. Pat. No. 4,594,220, a multistep method which involves sintering a compressed mixture of tungsten and scandium hydride powder previously deposited onto a porous barium and scandium oxide-containing porous tungsten substrate. In another method, disclosed by Hitachi Corporation in U.K. Patent 2,170,950, a combination of metal (preferably tungsten) and scandium oxide is deposited onto an conventinal scandate type scandium oxide impregnated cathode surface by sputtering. This method has proven to produce erratic and inconsistent results because of the difficulty in maintaining the correct ratio of metal and scandium oxide in the sputtered layer.

It is therefore the objective of the present invention to provide an improved scandate cathode and a simpler method for making same.

SUMMARY OF THE INVENTION

The present invention is a low work function scandate surface for a dispenser cathode structure and a method of making same. The cathode comprises an outer electron emitting surface comprising a core or substrate which is a matrix composed of a major part of porous tungsten with minor parts of a barium-containing impregnant and, occasionally, scandium oxide distributed therethrough, and with a nanometer thick layer of barium activated scandium oxide being deposited on the outermost surface thereof as the electron emitting material. The cathode structure further comprises a heater and an insulator. All of the above listed components are held together to form a finished cathode structure by a sleeve or other retaining device.

The method of making the above-described cathode comprises depositing a layer of scandium oxide onto the outermost surface of a barium impregnated tungsten-containing substrate. The deposited oxide layer has a final thickness in the range of between about 1 and about 30 nanometers. Any conventional deposition method that produces the coating may be used as long as the deposited coating has the proper thickness and composition. Suitable methods include sputtering and evaporation chemical vapor deposition (CVD). The deposited scandium oxide surface layer is then exposed to an oxygen atmosphere for between about 2 and about 10 minutes at a temperature of between about 375° C. and 500° C., and an oxygen pressure of between about $10^{-5}$ and about $10^{-7}$ torr. The oxygen exposed oxide surface layer is then activated by turning on the cathode heater, for example, to cause the release of a small portion of the barium in the barium impregnant and the subsequent migration of at least some of the released barium into the scandium oxide surface layer. This forms a monolayer of barium oxide on at least a portion of the scandium oxide surface layer.

The work function of the activated surface, when made by the process described above, is in the range of between about 1.5 and 1.6 eV. Further, the binding energy of barium oxide to scandium oxide is very high, so that the surface complex formed by this process is quite stable, even at temperatures in excess of about 700° C.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is an overall plan view of a typical dispenser cathode structure containing the scandate coating of the present invention;

FIG. 2 is useful in illustrating one method in accordance with the principles of the present invention.

DETAILED DESCRIPTION

Figure 3:
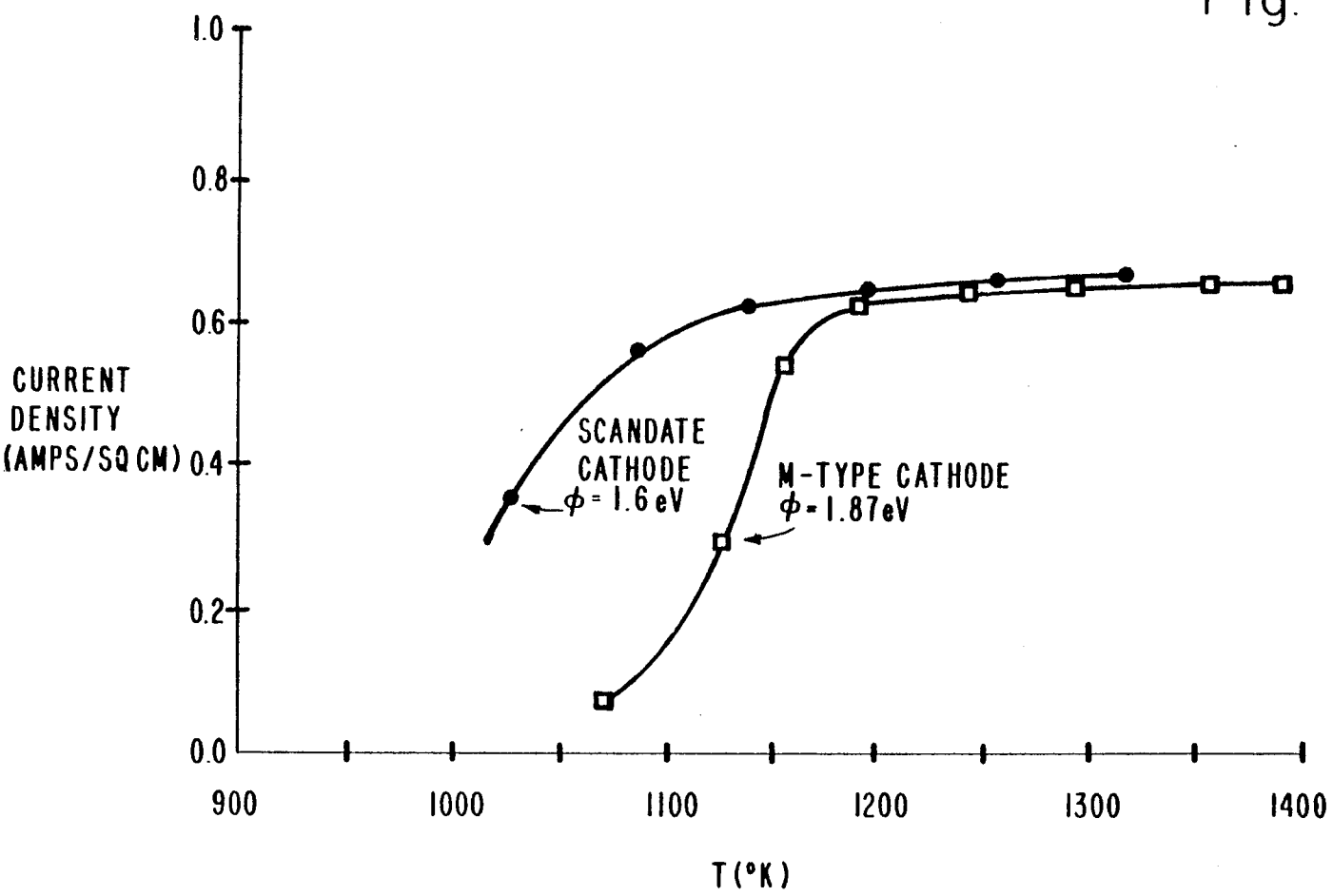
FIG. 3 is a graph showing the improvement in surface work function achieved with a cathode structure of the present invention as compared to a conventional M type cathode.

FIG. 1 illustrates a typical configuration for an electron emitting dispenser cathode structure 10. As shown therein, the cathode structure 10 comprises an outer electron emitting surface formed of a porous tungsten substrate 12. The porous substrate 12 is impregnated with a barium containing electron activator distributed therethrough, preferably, barium-calcium aluminate, and further, has a nanometer thick uppermost layer 14 of scandium oxide deposited thereon. Also shown in FIG. 1 are a heater 16, an alumina insulator 18 into which the heater 16 is placed, and a retainer 20, which is typically a can or flanged sleeve and which holds all of the constituent parts of the assembled dispenser cathode structure 10 in proper position for subsequent use. For the purposes of the subsequent discussion, it is known that the heater 16, the insulator 18 and the retainer 20 are all more-or-less standard in the art.

In the structural embodiment shown in FIG. 1. the porous tungsten substrate 12 is typically a blank that is about one inch square by about ¼ inches thick. This blank is normally fabricated from tungsten powder having a particle size in the range of between about 4.0 to about 7.5 microns in diameter, that is compacted and fused to form a finished substrate blank having a density which is usually about 80±10% of theoretical density. When the blank is to be used as the substrate 12 for the dispenser cathode structure 10 of the type herein described, one widely used technique for impregnating the porous blank with a barium containing activator is by capillary action. Typically, this is accomplished by heating the blank to a temperature above the melting point of a "4-1-1" barium-calcium-aluminum oxide mixture, i.e., one having a molar ratio of about 4 parts of barium oxide to about 1 part each of calcium oxide and aluminum oxide, and then immersing the heated blank in this oxide mixture.

In the present invention, the uppermost layer 14 has a scandium oxide thickness in the approximate range between 1 to 30 nanometers, preferably between 5 and 20 nanometers, more preferably between 8 and 15 nanometers, and most preferably between 10 and 12 nanometers. In these approximate ranges, the $Sc_2O_3$ thickness is so low that its resistance does not seriously impede a high current electron flow from substrate 12. The scandium oxide uppermost layer 14 may be deposited by a number of well known methods, such as by chemical vapor deposition and sputtering, but is preferably deposited by sputtering $Sc_2O_3$ onto the uncoated, outermost surface of the substrate 12, using an argon plasma as the carrier. In the preferred process, as illustrated in FIG. 2, an R.F. generator 22 is internally D.C. biased to make the target area of the substrate 12 negative relative thereto. By so doing, a charge is prevented from building up on an insulating scandium oxide electrode 24 employed to deposit the uppermost layer 14 on the substrate 12. Further, $O_2$ gas can also be injected along with the argon to control the final product composition.

Because of the uncertainties associated with a deposition process such as sputtering, it is preferred that before a full production run is started, the rate of scandium oxide deposition be determined first by running a blank sample at a given R.F. generator 22 power level for a given time. After measuring the thickness of the scandia layer deposited thereon, the run time needed to deposit any given thickness of scandium oxide can be easily established. Preferably, this time is adjusted to that required to deposit about a 10 nanometer thick layer of scandium oxide on the outermost surface of the tungsten-containing substrate 12. At the conclusion of the sputtering step, to ensure that the deposited surface layer 14 is all $Sc_2O_3$ and not just scandium rich $Sc_2O_3$, the scandium oxide outer surface 14 of substrate 12 is exposed to an oxygen atmosphere for a time between about 2 and 10 minutes, preferably between about 4 and about 7 minutes, at between about 375° C. and 500° C., preferably between about 400° C. and about 450° C., at an oxygen pressure of between about $10^{-5}$ and about $10^{-7}$ and preferably between about $1\times10^{-6}$ and about $6\times10^{-6}$ torr.

Following these steps, the surface 14 is activated by turning on the heater 16 and operating the dispenser cathode structure 10 as a low surface work function electron emitting cathode. Alternatively, other means of heating the structure to activate the surface 14 may be employed. Every time the porous cathode structure 12 is heated. small amounts of barium are released by a reaction of the barium-containing impregnant with the tungsten. During such operation, at least some of the released barium will migrate into the thin scandium oxide surface layer 14, where it forms a monolayer of BaO on at least a portion thereof, thus completing the activation of the low work function surface of cathode structure 10. This barium release and migration continues throughout the effective lifetime of the cathode structure 10, thus maintaining its low work function surface characteristics without a significant diminution of same occurring during this time.

The degree of improvement achieved with cathodes made by the method of the present invention is shown in FIG. 3. This shows that at a current density of approximately 3.75 amperes/$cm^2$ a work surface energy value of about 1.6 electron volts is achieved at a working temperature of about 1000° K., whereas a comparable conventional standard M cathode showed, at this same current density, a work surface energy value of about 1.9 electron volts at a working temperature in excess of 1100° K.

In still other embodiments of the present invention, the barium activator may be applied either by spraying a small amount of barium oxide onto the upper surface of the impregnated core cathode structure 10 prior to sputtering the scandium oxide thereon, or by cosputtering barium oxide with the scandium oxide. Further, the tungsten substrate 12 may also have some amount of scandium oxide mixed in prior to the sintering operation. Regardless of how the scandium oxide surface is activated with barium oxide, the resultant cathode structure 12 is characterized by having a low work function surface which is further characterized by being a copious electron emitter at relatively low operating temperatures and having a long service lifetime.

Thus there has been described a new and improved barium-activated scandium oxide-containing surface coating for a dispenser cathode structure and methods for making same. It is to be understood that the above-described embodiments are merely illustrative of some of the many other specific embodiments which represent applications of the principles of the present invention. Clearly, numerous and other arrangements can be readily devised by those skilled in the art without departing from the scope of the invention.

What is claimed is:

1. A low work function scandate surface coating for a dispenser cathode structure containing an outer surface substrate composed of porous tungsten impregnated with a barium containing impregnant distributed therethrough, the surface coating comprising a 1 to 30 nanometer thick layer of scandium oxide deposited onto the outermost portion of the substrate, the scandium oxide surface coating further comprising an activating amount of barium oxide.

2. The cathode coating of claim 1 wherein the scandium oxide coating layer has a thickness in the range between about 5 and 20 nanometers.

3. The cathode coating of claim 1 wherein the scandium oxide coating layer has a thickness in the range between about 8 and 15 nanometers.

4. The cathode coating of claim 1, wherein the scandium oxide coating layer has a thickness in the range between about 10 and 12 nanometers.

5. The cathode coating of claim 1 wherein the surface coating is deposited by sputtering.

6. The cathode coating of claim 1, wherein the porous tungsten substrate has a density of 80±10 percent of its theoretical density and the barium containing impregnant is barium-calcium aluminate.

* * * * *